United States Patent [19]

Dulisse

[11] Patent Number: 4,792,136

[45] Date of Patent: Dec. 20, 1988

[54] CONVERTIBLE BOWLING ALLEY

[76] Inventor: David Dulisse, 30 Bluefields La., Blauvelt, N.Y. 10913

[21] Appl. No.: 89,079

[22] Filed: Aug. 25, 1987

[51] Int. Cl.[4] ..... A63D 5/00

[52] U.S. Cl. ..... 273/51

[58] Field of Search ..... 273/8, 9, 51, 54 R; 124/20 R, 20 A, 20 B

[56] References Cited

U.S. PATENT DOCUMENTS 516,852 3/1894 Trumble ..... 124/20 B 4,420,155 12/1983 Sheinberg et al. ..... 273/51

*Primary Examiner*—Anton O. Oechsle

*Attorney, Agent, or Firm*—Weingram & Zall

[57] ABSTRACT

A bowling alley is provided having a bowling lane bed which includes an approach, a foul line at one end, a pin deck at the other end and a plurality of lane support members below said bed as well as a pair of gutters running parallel to and abutting each side of the bowling lane bed. A deflection means is removably disposed longitudinally along both sides of said lane bed outside of said gutters for deflecting a bowling ball rolled down the lane. The deflection means prevents the ball from falling into the gutters. The deflection means extends along at least a portion of each side of said lane bed between the foul line and the pin deck. Upright pin support members are provided at each end of the deflection means. Each of the members is removably disposable at its lower end in a pin clamping means located below the lane bed and between the gutter and lane bed. Each of the deflection means is also removably supported substantially vertically above the lane bed by the pin members. A pin clamping means is mounted to a lane bed support member and includes at least one slot, and preferably two slots which are slidingly engageable with the pin member. The bowling alley can serve as a conventional alley when the deflection means and the pin members are removed and as a carom bowling alley when the deflection means are supported in place.

15 Claims, 5 Drawing Sheets

54
52
36
50
54
48
44
70
74
72
76
68
82
56
86
84
58
80
74
70
46

CONVERTIBLE BOWLING ALLEY

BACKGROUND OF THE INVENTION

1. Field of the Invention

The present invention relates to bowling alleys and, in particular, to bowling alleys which may be used by youngsters or other persons having a relatively low skill in bowling. In particular, this invention relates to a convertible bowling alley wherein deflection means are disposed along the alley gutters to provide a deflection surface for the bowling ball when it is directed toward the gutters and permits it to deflect onto the bowling alley to cause a higher knockdown of pins.

Bowling requires a great deal of skill to perfect. Usually after a certain age this skill is developed and enjoyment can be had. However, when a youngster or physically disabled person bowls on a standard bowling alley, the ball tends to go into the gutter an unusually large number of times, providing for a low score, and less enjoyment. It is thus desirable to provide a bowling alley which can enhance the score of the individual bowling and provide for greater enjoyment.

2. Description of the Prior Art

U.S. Pat. No. 3,401,933 to Conklin et al. discloses a convertible bowling lane suitable for ordinary bowling and carom bowling. The lane includes a movable means which, when retracted, defines the bottoms of the lane gutters along both sides of each lane and, when extended, provides upstanding ball deflection devices. The movable means is operated through a complex drive by a reversible motor energized by a control system. This system calls for considerable additional expense in new bowling alleys to be so built as well as for extensive and expensive remodelling for alleys already existing. This is a substantial inhibiting factor in the use of this device.

The high expense for such a device and susceptibility to failure due to the complexity of this system were attempted to be overcome by Sheinberg et al., see U.S. Pat. Nos. 4,330,122 and 4,420,155. Sheinberg et al. provides or a removable deflection means as opposed to merely a movable deflection means. Sheinberg et al. describes the use of various deflection means which are removably disposable in the gutter, conveniently stored when removed and in some embodiments nest or fit in the gutters abutting the bowling lane on both sides thereof. In a preferred embodiment elastic bands extend along both sides of the lane starting at the foul line and extending to the pin deck. Sheinberg et al., in FIG. 22, discloses an embodiment of a deflection means wherein at least one elastic band is attached at both ends to a pin which is removably disposable in an opening located in the corner formed by the foul line and by the contact line of the lane and gutter. The other end is secured in the same manner at a distant end of the bowling lane. The elastic band is described as one of sufficient width and of sufficient tension to deflect misdirected bowling balls back onto the lane bed.

A deficiency of Sheinberg et al. is that he does not describe any practical means for inserting the pins in the lane. Applicant has discovered that due to the length of the bowling lane and the amount of material utilized for the deflection means that the pins must be securely positioned. Merely drilling a hole or placing a slot in the lane is not adequate to maintain the pin in the lane when balls carom off the band. Applicant has also discovered that in devising such a deflection means it is at times difficult to mount the deflection means, e.g. bands, to the pins. A further difficulty is that when the deflection pins are mounted down the lane away from the foul line, to provide a certain amount of skill in the game, the ball tends to hit the forward pins holding up the band and damage the pin and bowling ball. Further, the bands after a period of time in use tend to stretch. It is thus desirable to have a means for adjusting the bands. For all the foregoing reasons, Sheinberg et al.'s device is commercially unacceptable.

OBJECTS AND SUMMARY OF THE INVENTION

It is an object of this invention to provide a convertible bowling alley which provides deflection means along the gutters which can be removably mounted to the bowling alley.

It is a further object of this invention to provide deflection means which are bands which fit onto removable pins to provide an easy manner of mounting said bands.

It is still a further object to provide a means for adjusting the tension in the deflection means.

It is yet another object of this invention to provide a means for preventing damage to the pins used to mount the deflection when they are mounted down the lane away from the foul line.

All of the foregoing objects are obtained by providing a bowling alley comprising:

(a) a bowling lane bed including an approach and a foul line at one end, a pin deck at the other end and a plurality of lane bed support members below said bed;

(b) a pair of elongated gutters abutting each side of said bowling lane bed;

(c) deflection means removably disposed longitudinally along both sides of said lane bed and outside of said gutters for deflecting a bowling ball rolled down said lane to thereby prevent said ball from falling into said gutters, said deflection means extending along at least a portion of each side of said lane bed between said foul line and said pin deck;

(d) upright pin members at each end of each of said deflection means, each of said pin members removably disposable at its lower end in a pin clamping means located below the lane bed between the gutter and lane bed, each of said deflection means being removably supported substantially vertically above said lane bed by said pin members;

(e) each of said pin clamping means mounted to a lane bed support member and having a slot slidingly engageable with said pin member.

Preferably at least one end of each of the deflection means, the pin clamping means has a plurality of slots slidingly engageable with the respective pin member, whereby the tension in the deflection means between the respective pin members can be selectively increased or decreased by selection of the appropriate slot into which to insert the pin member.

Preferably, the pin members closest to the foul line have mounted thereto a bumper means for deflecting the bowling ball away from the pin members.

It is preferred to provide at each end of the flexible material of the deflection means loops for removably engaging the respective pins at each end, preferably, with at least one end of each deflection means having a hand hold for providing tension to the deflection means for engaging the loop to a respective pin member.

DETAILED DESCRIPTION OF THE INVENTION

The invention described herein is merely illustrative of exemplary embodiments of the invention. It should be understood that many embodiments of the present invention are possible.

Figure 1:
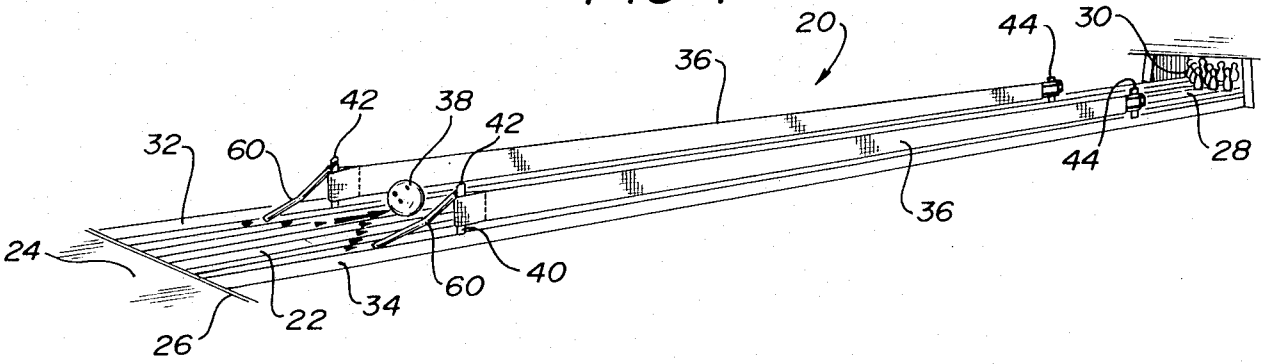
FIG. 1 is a perspective view of the convertible bowling alley of this invention.
Figure 1A:
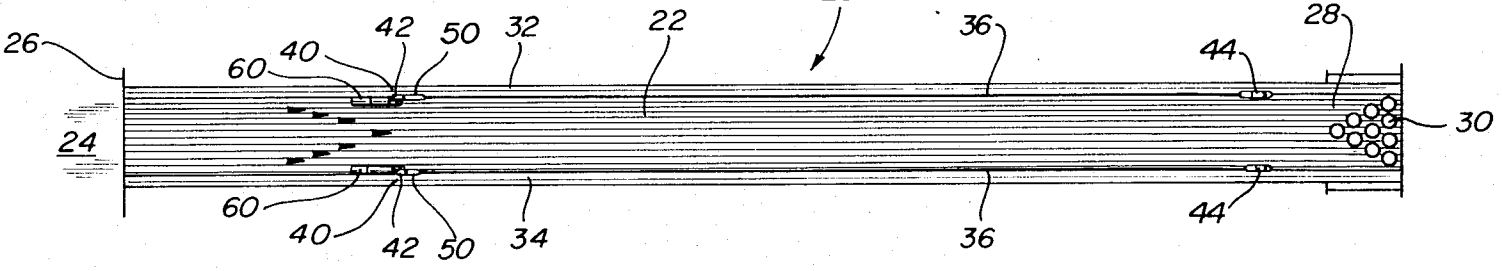
FIG. 1(A) is a plan view of said bowling alley.

FIGS. 1 and 1(A) show the use of this invention in a standard bowling alley, generally designated 20. The bowling alley 20 has a bowling lane bed 22 which includes an approach 24 and a foul line 26 at one end. A pin deck 28 is provided at the other end for supporting the bowling pins 30. A pair of elongated gutters, 32 and 34, run parallel to and abutting each side of the bowling lane bed 22.

This invention provides for a deflection means 36 removably disposed longitudinally along both sides of the lane bed 22 and outside of the gutters, 32 and 34. By the use of the term "outside" as used herein it is meant that the deflection means 36 lies substantially along a line joining the lane bed 22 and gutters 32 and 34. The deflection means 36 provides for the deflection of a bowling ball 38 rolled down the lane 22 and prevents the ball 38 from falling into the gutters, 32 or 34.

Figure 2:
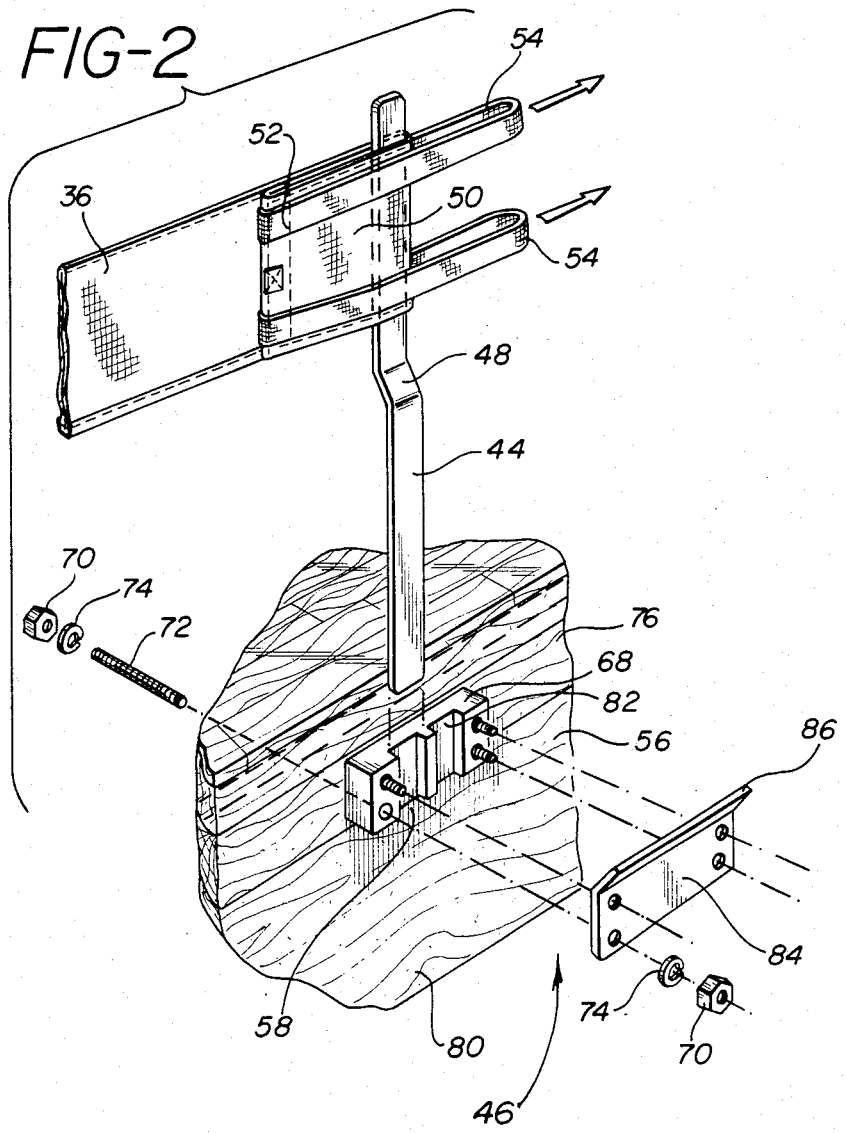
FIG. 2 is a break-a-way perspective view of the pin clamping means used in this invention.
Figure 3:
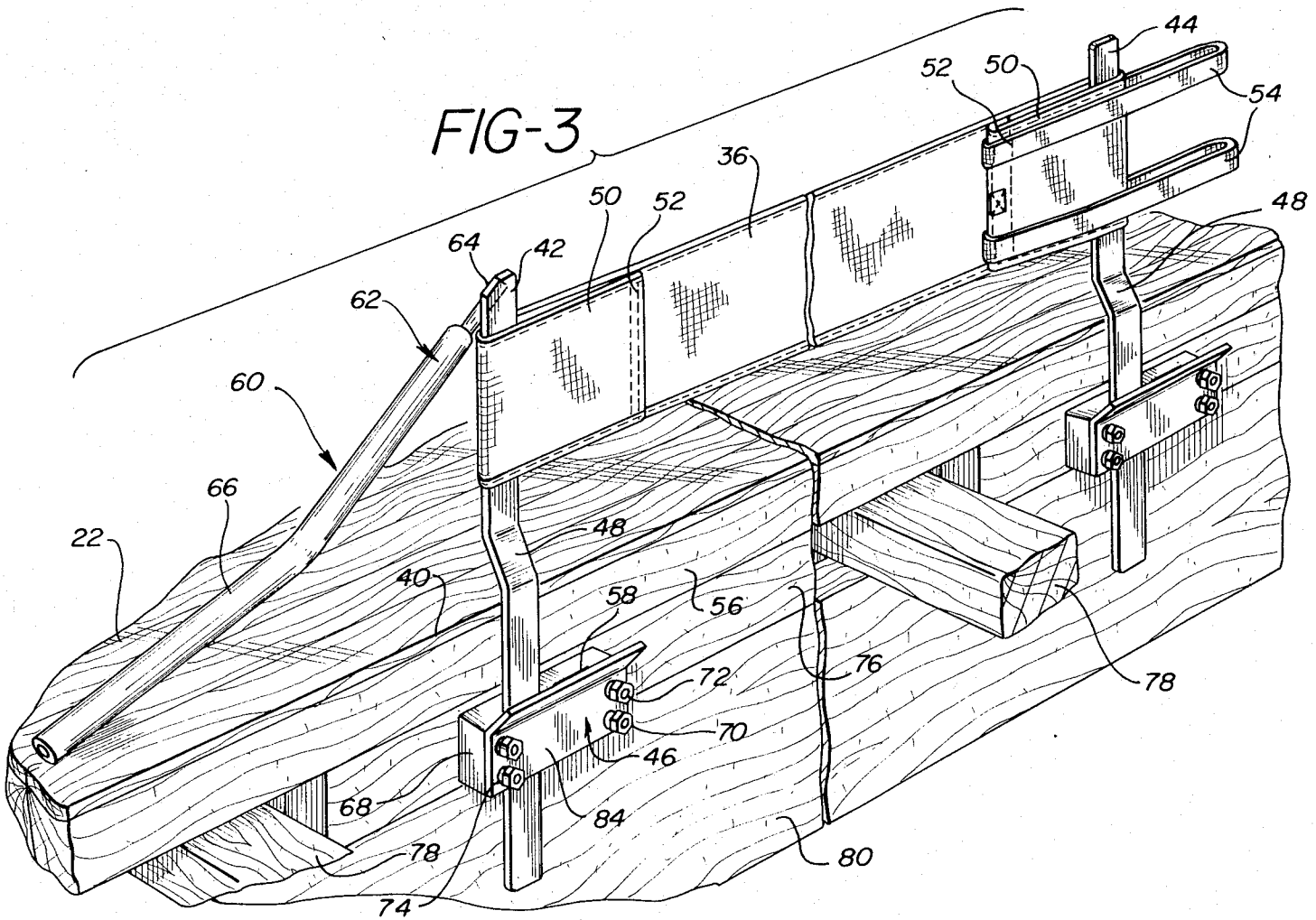
FIG. 3 is a perspective of the side of the bowling alley with the deflection means in place.

Referring to FIGS. 2 and 3, preferably the deflection means 36 is a cloth material which is, for example, a rubberized canvas or nylon material. The width of the material should be of sufficient width to provide a deflection area for the ball 38 when it rolls down the lane 22. A preferred width is about seven inches, however a smaller or larger width may be utilized.

Referring to FIGS. 1 and 1(A), the deflection means 36 extends along at least a portion of each side of the lane bed 22 between the foul line 26 and the pin deck 28. In a preferred embodiment, the deflection means 36 extends from a point about fifteen feet from the foul line, e.g. 40, to just before the pin deck 28. This manner of mounting the deflection means 36 allows one to demonstrate a certain amount of skill in not throwing gutter balls. This distance between the foul line and point 40, i.e. the initiation of the deflection means 36, may be set prior to mounting the invention on the bowling alley to provide for persons having a greater or lesser degree of skill in bowling, the least amount of skill being required when point 40 is coincident with the foul line. A preferred distance from the follow line is between 10 and 20 feet, e.g. 10 to 15 feet.

Referring to FIGS. 2 and 3, upright pin members 42 and 44 are provided at each end of the deflection means 36. Each of these pin members 42,44 is removably disposable at its lower end in a pin clamping means, generally designated 46, located below the lane bed 22 and between the gutter 32,34, and the lane bed 22. The pin members are preferably made of a resilient elongated material, e.g. steel. In a preferred embodiment these pin members are about two feet long, one-and-a-quarter inches wide and three-sixteenth inches thick. Preferably, the pin member 42,44 has an offset bend 48, for example, at the midpoint of the pin. This offset bend 48 has several functions, i.e. it maintains a certain length of pin above the lane bed 22 by having the bend rest on the lane bed 22 when in position. Additionally, the offset bend 48 provides a way of accurately positioning the deflection means 36 on the line separating the lane bed 22 and the gutter, 32,34, due to the fact that the pin clamping means 46 cannot be placed directly under this line. The offset bend 48 also allows the bowling ball to roll through the gutter without hitting the pin member 44.

Still referring to FIGS. 2 and 3, the pin members, 42,44, permit each of the deflection means 36 to be substantially vertically supported above the lane bed 22 by the pin members, 42 and 44. Preferably the deflection means 36 comprises an elongated rubber canvas material or nylon which has at each end thereof a loop 50 which can removably engage the respective pin, 42,44. This loop 50 is produced by taking the end of the canvas material, folding it over, and stitching it at stitch line 52. This loop 50 should be large enough to engage the pin member 42,44 and easy to slip over the pin 42,44 when placing it thereon. Optionally, there may be provided a plurality of loops to provide for adjustments in the tension between the pin members.

As shown in FIGS. 2 and 3, at least one end of each of the deflection means 36 has at least one hand hold and preferably two hand holds 54 thereon. The hand holds 54 are used to provide tension to the deflection means 36 for engaging the loops 50 to their respective pin members 42,44 Thus, in installing the deflection means 36, the front loop 50 of the deflection means is placed over pin 42 which is inserted in the clamping means 46. The deflection means 36 is then taken by the hand holds 54 and pulled in the direction of the arrows to provide tension thereon. The loop 50 is then placed over pin member 44, which has already been inserted in the rear clamping means 46. The hand holds 54 thus provide for a simple, easy and convenient means for installation of the deflection means 36.

Still referring to FIGS. 2 and 3, the pin clamping means 46 is mounted to a lane bed support member 56, discussed below. The clamping means 46 has at least one slot therein 58 which is slidably engageable with the respective pin member 42,44. Preferably, at least one end of each of the deflection means 36, and preferably at both ends, the pin clamping means 46 has a plurality of slots 58 which are slidably engageable with respective pin member 42,44. Thus, after use of the deflection means 36 for a certain amount of time causes the material to stretch, the tension of the deflection means 36 between the respective pin members 42,44 can be selectively increased by selection of the appropriate slot into which to insert the pin member 42,44. Thus, at the initiation of use, the slots 58 which are closest together along the length of the lane bed 22 may be utilized for holding the pin members 42 and 44 and as time goes on the separation may be increased incrementally to increase the tension. When the deflection means has a plurality of loops 50 additional separation adjustments may also be obtained.

Figure 4:
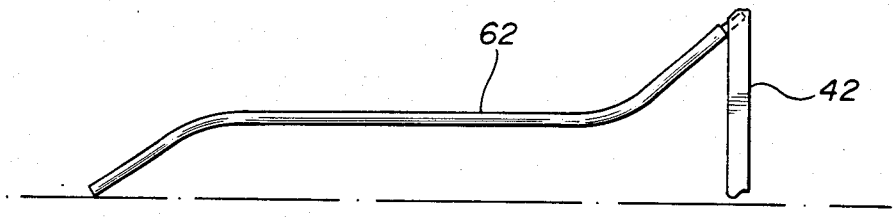
FIG. 4 is a side view of another configuration of the deflection means.

In the preferred embodiment wherein the pin members 42 are mounted a distance down the lane bed 22 from the foul line 26, it is preferred that each of them have mounted thereto a bumper means 60 for deflecting the bowling ball 38 from the front pin member 42. In the preferred embodiment depicted in FIG. 3, the bumper means 60 comprises an elongated resilient member 62 bending toward the foul line 26 from the top 64 of pin member 42 to the lane bed 22. A slight crimp or bend 66 is provided in the elongated member 62 to ensure that the bowling ball 38 does not hit pin member 42. The elongated member 62 is preferably covered with a rubberized material 66 so that the bowling ball 38 is not damaged when it contacts the bumper means 60. Preferably, the bumper means 60 extends from about two to four feet toward the foul line from the pin member 42, although this is not critical. Other type bumper means may also be used. Such is depicted in FIG. 4.

Referring to FIGS. 2 and 3, in the preferred embodiment, the pin clamping means 46 comprises a first plate 68 which is mounted to the lane support member 56. This could be accomplished in several ways. For example, the first plate 68 may be mounted directly to a lane support member by a plurality of nuts 70, studs 72 and lock washers 74 as shown in FIG. 2, or the plate 68 may be mounted onto a block 76, in the same manner, which is then mounted to the lane bed support members 56. This is the embodiment shown in FIG. 3. This latter method would most likely be a preferred method because the lane bed support members are typically supported on 2 inch×4 inch members 78 which go across the lane bed 22 and 2 inch×10 inch members 80 which run the length of the lane bed 22. Thus, it is unlikely that the first plate member 68 can be directly mounted to 2 inch×4 inch member 78 or 2 inch×10 inch member 80 and have it in the appropriate position for the pin member 42. Thus, one would mount the plate member 68 to the block 76, insert it between the lane bed 22 and the 2 inch×10 inch member 80 and either by nailing, screwing or possibly even gluing, maintain it in that position.

Figure 5:
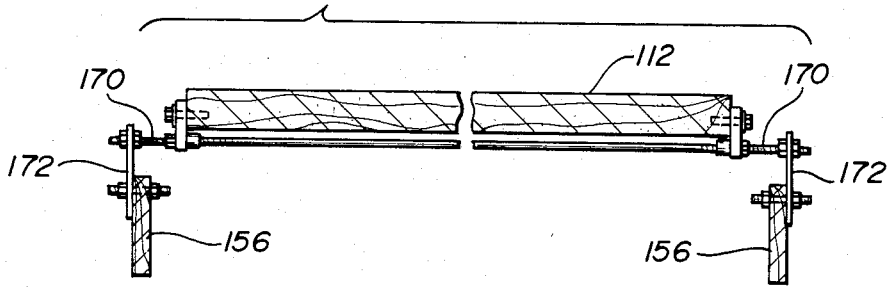
FIGS. 5–8 depict another method for mounting the pin clamping means to the lane bed.
Figure 6:
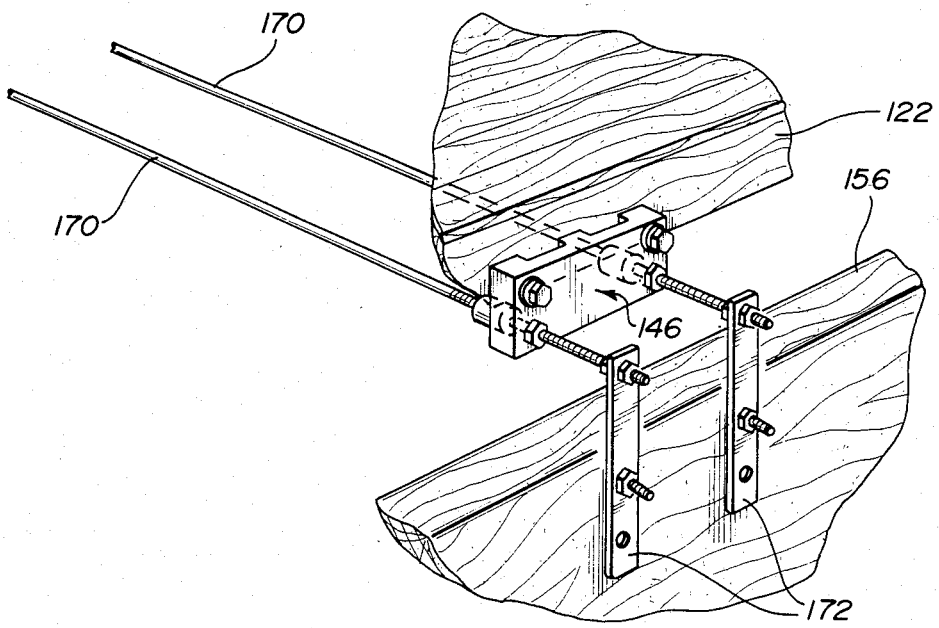

Another method of mounting pin clamping means is depicted in FIGS. 5–8. In FIGS. 5 and 6, the lane bed support member 156 is displaced a distance from the edge of lane bed 122. Extension rods 170 are threaded through two threaded holes 172 at the lower end of clamping means 146. Lock nuts are applied. The rods 170 extend outwardly to connect to struts 172 which are counted to lane bed support 156. Rods 170 are mounted in the same manner on the opposite side of lane 122.

Figure 7:
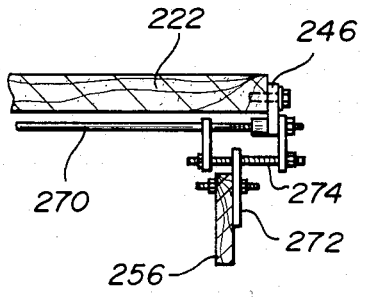
Figure 8:
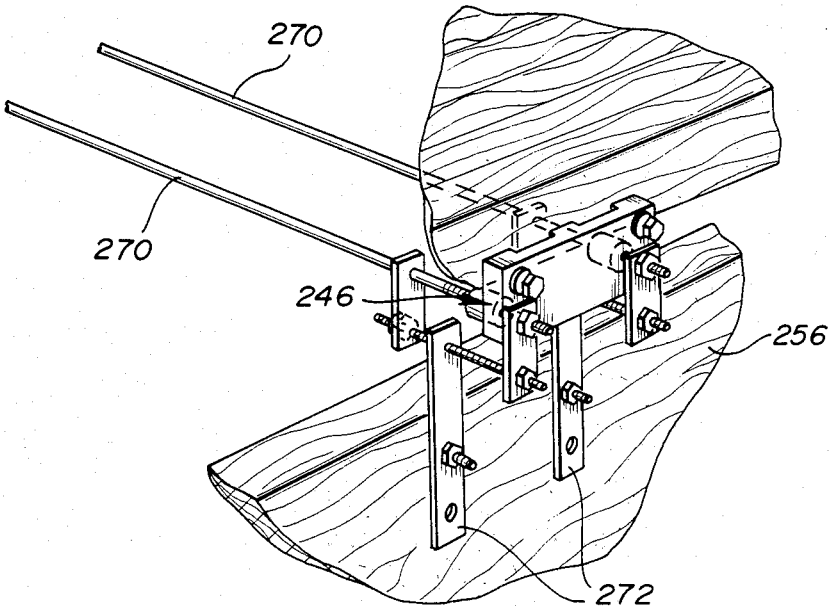

Referring to FIGS. 7 and 8, in a like manner the pin clamping means 246 is mounted to lane bed 222 by extension rods 270 and struts 272 and rods 274 when the lane bed support member 256 is below lane bed 222.

Referring to FIG. 2, the first plate 68 preferably includes a plurality of vertical channels 82 therein. A second plate 84 is provided which is mountable thereon. The channels 82 and second plate form the plurality of slots 58 in the clamping means 46. In the preferred embodiment depicted in FIG. 2, the nuts 70, studs 72 and lock washers 74 are utilized to clamp the first and second plates together onto block 76. Plate 84 may have a bend 86 on the top thereof to guide pin member 44 into channels 82.

The foregoing described device is extremely simple to install in a bowling alley in that after installation of the clamping means 46, which requires lifting the gutters and installing the clamping means 46 below the lane bed 22, the front pin members 42 along with the bumper means 60 are inserted into the slots 58 in the clamping means 46 and the deflection means stretched therebetween and placed on the rear pin member 44. All this takes about two minutes per lane to install and about one minute per lane to remove.

Having disclosed a specific embodiment of the invention, I do not intend that this invention be limited to specific construction set forth, but rather construed broadly according to the true spirit thereof as set forth in the following claims.

What is claimed is:

1. A bowling alley comprising:

(a) a bowling lane bed including an approach and foul line at one end, a pin deck at the other end and a plurality of lane bed support members below said bed;

(b) a pair of elongated gutters abutting each side of said bowling lane bed;

(c) deflection means removably disposed longitudinally along both sides of said lane bed outside of said gutters for deflecting a bowling ball rolled down said lane, to thereby prevent said ball from falling into said gutters, said deflection means extending along at least a portion of each side of said lane bed between said foul line and said pin deck;

(d) upright pin members at each end of each of said deflection means, each of said members removably disposable at its lower end in a pin clamping means located below the lane bed and between the gutter and lane bed, each of said deflection means being removably supported substantially vertically above said lane bed by said pin members;

(e) said pin clamping means mounted to a lane bed support member, said clamping means having at least one slot slidingly engageable with said pin member;

(f) at at least one end of each of said deflection means, said pin clamping means has a plurality of slots slidingly engageable with said respective pin member whereby the tension in the deflection means between said respective pin members can be selectively increased or decreased by selection of an appropriate slot into which to insert said pin member;

whereby said bowling alley can serve as a conventional alley when said deflection means and said pin members are removed and can serve as a carom bowling alley when said deflection means are supported in place.

2. The bowling alley of claim 1, wherein each of the pin members closest to said foul line has mounted thereto a bumper means for deflecting said bowling ball away from said pin members.

3. The bowling alley of claim 1, wherein each of said deflection means comprises an elongated flexible material having at each end thereof at least one loop for removably engaging the respective pin members.

4. The bowling alley of claim 3, wherein at least one end of each deflection means has at least one hand hold for providing tension to the deflection means for engaging the loop to the respective pin member.

5. The bowling alley of claim 3, wherein said flexible material is a rubberized canvas or nylon.

6. The bowling alley of claim 1, wherein said pin clamping means comprises a first plate mounted to said lane support member, said first plate including a plurality of vertical channels therein, and a second plate mountable thereto said channels and second plate forming said plurality of slots.

7. A bowling alley comprising:

(a) a bowling lane bed including an approach and a foul line at one end, a pin deck at the other end and a plurality of lane bed support members below said bed;

(b) a pair of elongated gutters abutting each side of said bowling lane bed;

(c) deflection means removalby disposed longitudinally along both sides of said lane bed outside of said gutters for deflecting a bowling ball rolled down said lane, to thereby prevent said ball from falling into said gutters, said deflection means extending along at least a portion of each side of said lane bed between said foul line and said pin deck;

(d) upright pin members at each end of each of said deflection means, each of said members removably disposable at its lower end in a pin clamping means located below the lane bed and between the gutter and lane bed, each of said deflection means being removably supported substantially vertically above said lane bed by said pin members;

(e) a bumper means for deflecting said bowling ball away from said pin members mounted to each of the pin members closest to said foul line;

(f) said pin clamping means mounted to a lane bed support member, said clamping means having a slot slidingly engageable with said pin member;

whereby said bowling alley can serve as a conventional alley when said deflection means and said pin members are removed and can serve as a carom bowling alley when said deflection means are supported in place.

8. The bowling alley of claim 7, wherein at at least one end of each of said deflection means, said pin clamping means has a plurality of slots slidingly engageable with said respective pin member whereby the tension in the deflection means between said respective pin members can be selectively increased or decreased by selection of an appropriate slot into which to insert said pin member.

9. The bowling alley of claim 7, wherein said bumper means comprises an elongated resilient member extending toward the foul line from the top of said pin member to the lane bed.

10. The bowling alley of claim 7, wherein the pin members closest said foul line are mounted a distance from said foul line.

11. The bowling alley of claim 10, wherein said distance is from about 10 to 20 feet.

12. The bowling alley of claim 10, wherein said distance is from about 10 to 15 feet.

13. The bowling alley of claim 7, wherein each of said deflection means comprises and elongated flexible material having at each end thereof at least one loop for removably engaging the respective pin members.

14. The bowling alley of claim 13, wherein at least one end of each deflection means has at least one hand hold for providing tension to the deflection means for engaging the loop to the respective pin member.

15. The bowling alley of claim 14, wherein said flexible material is a rubberized canvas or nylon.

* * * * *